US005171168A

United States Patent [19]

Chiodo

[11] Patent Number: 5,171,168

[45] Date of Patent: Dec. 15, 1992

[54] ELECTRICAL PLUG-SOCKET UNIT

[75] Inventor: Daniel J. Chiodo, Hialeah, Fla.

[73] Assignee: Manufacturers Components, Incorporated, Hialeah, Fla.

[21] Appl. No.: 775,518

[22] Filed: Oct. 15, 1991

[51] Int. Cl.[5] ..... H01R 13/00

[52] U.S. Cl. ..... 439/651

[58] Field of Search ..... 439/651, 652

[56] References Cited

U.S. PATENT DOCUMENTS

| | | | |
|---|---|---|---|
| 2,226,433 | 12/1940 | Herman | 439/651 |
| 2,316,072 | 4/1943 | Judisch | 173/334 |
| 2,484,092 | 10/1949 | Hopgood | 439/651 |
| 2,554,554 | 5/1951 | Billeter | 173/361 |
| 2,752,582 | 6/1956 | Cargill | 439/652 |
| 3,493,915 | 2/1970 | Cox | 439/651 |
| 3,579,175 | 5/1971 | Shroyer | 439/651 |
| 4,386,820 | 6/1983 | Dola et al. | 339/156 R |
| 4,768,965 | 9/1988 | Chang | 439/137 |
| 4,897,052 | 1/1990 | Priest et al. | 439/652 |

*Primary Examiner*—Joseph H. McGlynn

*Attorney, Agent, or Firm*—Oltman and Flynn

[57] ABSTRACT

This electrical plug-socket unit has a pair of integral, elongated, substantially rigid, electrically conductive prong-socket members embedded in a molded dielectric plastic body having several angularly disposed faces. Prong elements of the respective prong-socket members at one end project perpendicularly from one face of the dielectric body. Flat bifurcated elements at the opposite end of the respective prong-socket members are located behind another face, which has openings leading into these socket elements. Connecting segments of the prong-socket members between their prong and socket elements offset the socket elements laterally from each other and offset them angularly from the respective prong elements. In one embodiment there is a third prong-socket member in which the prong is a round ground prong that projects from the one face of the dielectric body and the socket element is a hollow member within the body. The hollow socket element is parallel to the bifurcated socket elements.

8 Claims, 3 Drawing Sheets

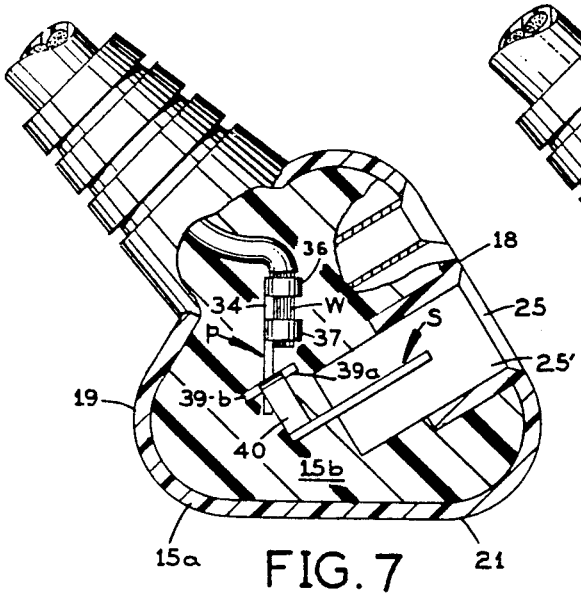
FIG. 7
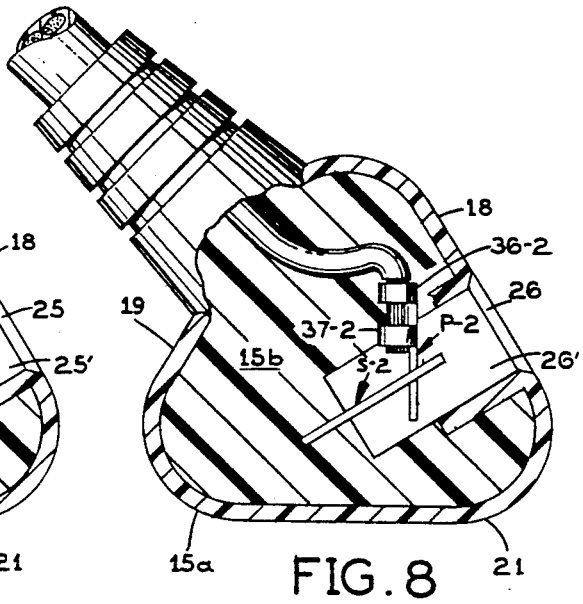
FIG. 8
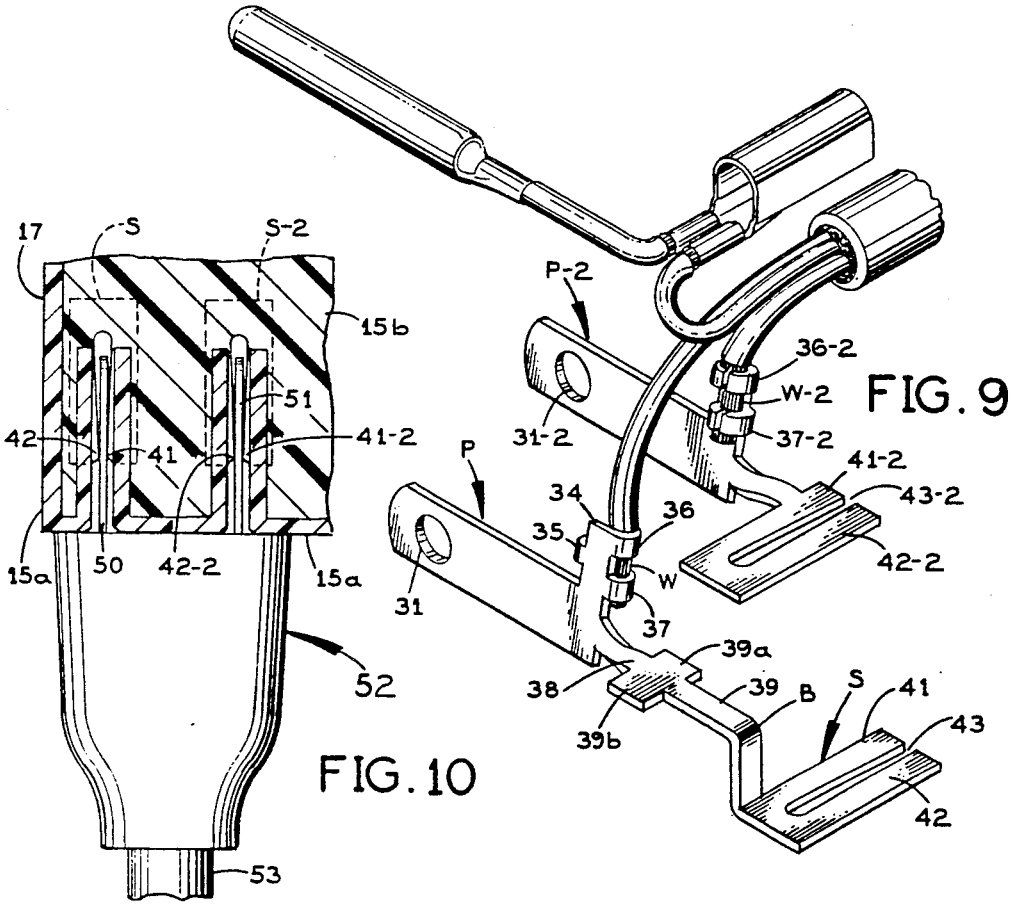
FIG. 9
FIG. 10

ELECTRICAL PLUG-SOCKET UNIT

SUMMARY OF THE INVENTION

This invention relates to an electrical plug-socket unit of the type commonly called a "piggyback plug", having a single body holding both prongs for insertion in another socket and a socket for receiving the prongs of another electrical connector.

A principal object of the present invention is to simplify and economize the manufacture of such plug-socket units by providing two unitary, substantially rigid prong-socket members of novel construction enabling them to be positioned for encapsulation in a molded plastic dielectric body with the respective prong elements parallel to each other and projecting perpendicularly out from one face of the molded body and with the respective socket elements embedded in the body parallel to one another behind another face of the body.

In one embodiment of the present invention a first prong-socket member has a connecting segment between a flat prong element and a bifurcated socket element, which connecting segment has a twisted portion joined at one end to the prong element, an elongated flat portion joined to the opposite end of the twisted portion at a bend end extending from it to the socket element. In this preferred embodiment, a shorter prong-socket member has a twisted connecting segment joining its prong element to its socket element. The twist in the connecting segment of each prong-socket member offsets the respective socket elements angularly with respect to the prong elements. The elongation of the connecting segment of the first prong-socket member and the bend in it offset its socket element laterally from the socket element of the second prong-socket member.

In another embodiment of the invention, there are three prong-socket members embedded in the dielectric body, with a prong element at one end and a socket element at the other end with the prong elements protruding through one of the faces of the dielectric body and the socket elements extending parallel to each other within the dielectric body behind another of the faces. Each of a pair of the prong-socket members is an elongated one-piece body having a planer prong element at one end thereof and a planar socket element at the other end thereof. A third prong-socket member has a round prong element at one end thereof outside the dielectric body and a hollow socket element at the opposite end thereof inside the dielectric body.

Further objects and advantages of this invention will be apparent from the following detailed description of a presently preferred embodiment which is illustrated schematically in the accompanying drawings.

DESCRIPTION OF THE DRAWINGS

FIG. 7 is a cross-section taken along the line 7—7 in FIG. 5;

FIG. 8 cross-section taken along the line 8—8 in FIG. 5;

FIG. 9 is a perspective view showing the two prong-socket members connected to corresponding lead-in wires and positioned to be encapsulated in a molded plastic dielectric body of the "piggyback" plug socket unit:

FIG. 10 is a fragmentary cross-section taken along the line 10—10 in FIG. 5;

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 3:
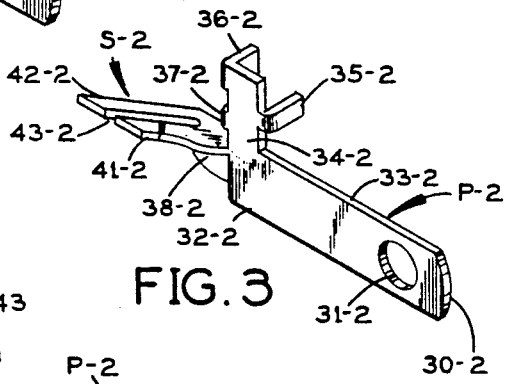
FIG. 3 is a perspective view of a second unitary prong-socket member in the present invention.
Figure 4:
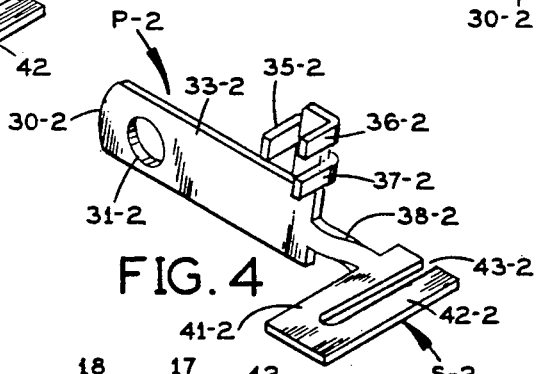
FIG. 4 is a perspective view of this second prong-socket member, viewed from the right rear of FIG. 3.
Figure 5:
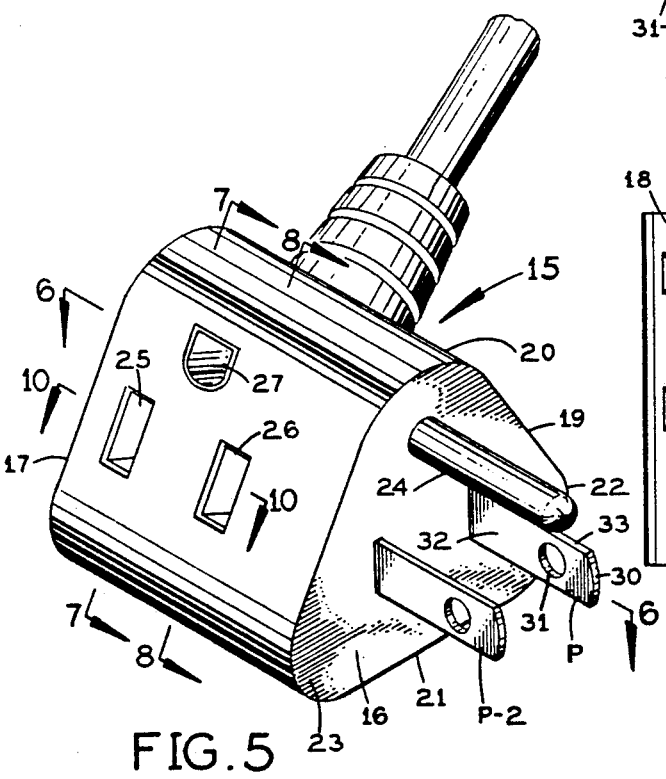
FIG. 5 is a perspective view of a "piggyback" plug socket unit embodying these two prong-socket members in accordance with the present invention.

FIG. 5 shows the completed "piggyback" plug socket unit in accordance with this invention, embodying the two prong-socket members shown in FIGS. 1-4 but otherwise similar to known plug-socket units. It has a molded dielectric plastic body 15 with flat opposite end faces 16 and 17 flat front face 18 extending between these end faces, a flat rear face 19 extending down behind the front face at an angle of about 60 degrees and connected to it by a rounded top corner 20, and a flat bottom face 21 extending between the front and back faces at respective angles of about 60 degrees and connected to them by rounded rear and front corners 22 and 23.

Flat electrical prong elements P and P-2 project perpendicularly away from the end face of the insulation body 15, as does a ground prong 24 of round cross-section. Prong elements P and P-2 extend parallel to each other perpendicular to the plane of the bottom face 21 of the insulation body 15 at equal distances from that face. The ground prong 22 is above and midway between prong elements P and P-2.

The front face 18 of insulation body 15 has a pair of rectangular openings 25 and 26 leading into corresponding recesses 25' and 26' (FIGS. 7 and 8) for receiving flat prongs on another electrical connector like the prong elements P and P-2. The front face 18 of the insulation body has a third opening 27, rounded on one side, leading into a socket for receiving a ground prong on the other electrical connector like the prong 24.

FIGS. 6–8 and 10 show the dielectric body 15 as having an outer layer 15*a* end an inner core 15*b*, both of suitable moldable plastic material. However, it is to be understood that the dielectric body 15 may be a single, integrally molded, one-piece member.

Figure 1:
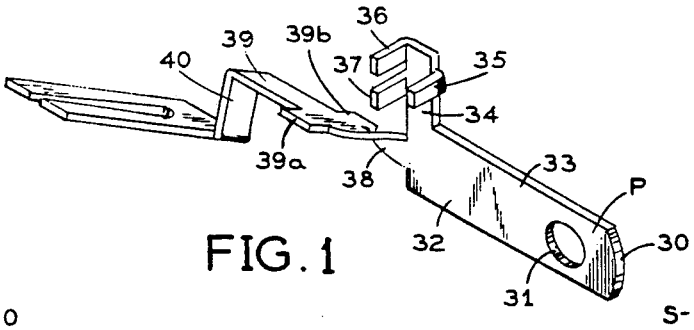
FIG. 1 is a perspective view of one of the two unitary prong-socket members in the one embodiment of present invention.
Figure 2:
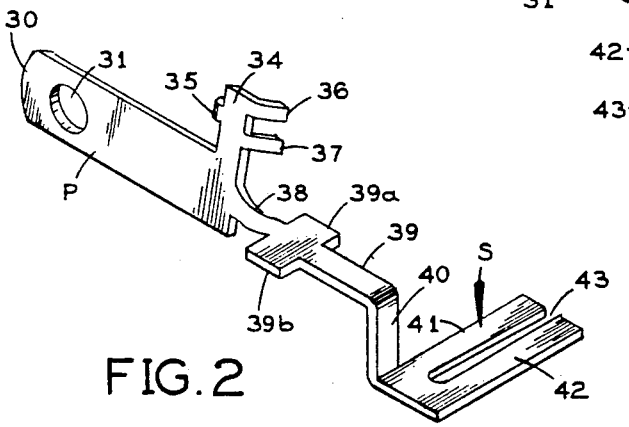
FIG. 2 is a perspective view of this prong-socket member, viewed from the right rear of FIG. 1.

Referring to FIGS. 1 and 2, the first prong-socket member in the present invention has the thin, flat, substantially planar, elongated prong element P, which has a rounded outer edge 30 and a circular opening 31 a short distance in from that edge. This prong element has closely spaced, parallel, flat, opposite major faces 32 and 33 which ere elongated beyond the end face 16 of the dielectric body 15 of the "piggyback" plug-socket unit in FIG. 5.

The first prong-socket member has a lead-in wire attachment segment at the inner end of its prong element P. This wire attachment segment comprises a flat arm 34 extending up from the prong element in FIG. 1 and co-planar with it and short bendable fingers 35, 36 and 37 extending perpendicular to arm 34 on opposite sides of it. These fingers are adapted to be bent around the bared end of a lead-in wire W to grip it tightly, as shown in FIGS. 7 and 8.

Below the wire attachment segment 34, 35, 36 37 the first prong-socket member has a connecting segment having a twisted portion 38 which extends inward from its prong element. The connecting segment also has a flat elongated portion 39 joined integrally to its twisted portion 38 at the end of the latter away from prong element P. The plane of the flat connecting portion 39 of the connecting segment extends at about 60 degrees to the plane of prong element P. Portion 39 has transversely projecting ears 39*a* and 39b where it is joined to the twisted connecting portion 38. Finally, the connecting segment of this prong-socket member has a flat, elongated, transverse portion 40 extending perpendicularly from the flat connecting portion 39 at the opposite end of the latter from the twisted connecting portion 38, forming a right-angled bend at B in the connecting segment.

The first prong-socket member has a substantially planar bifurcated socket element S joined integrally to the transverse connecting portion 40 of its connecting segment at the opposite end of the latter from portion 39 (the lower end in FIGS. 1 and 2). Socket element S has elongated flat fingers 41 and 42 extending on opposite sides of a gap 43, which is open at the opposite end of the socket element from its attachment to the transverse connecting portion 40. The plane of fingers 41 and 42 is parallel to the plane of the flat connecting portions 39 of the connecting segment of the first prong-socket member. Gap 43 is progressively narrower toward its open end (FIG. 6) so that the socket fingers 41 and 42 will be spread apart by the insertion of a corresponding prong on another electrical connector and they will grip this prong tightly.

The second prong-socket member, shown in FIGS. 3 and 4, is identical to the just-described first prong-socket member except that it does not have connecting segment portions like 39 and 40 in FIGS. 1 and 2. Corresponding elements of the second prong socket member have the same reference numerals, but with a "−2" suffix added, as those of the first prong-socket member so the detailed description of these elements need not be repeated. As best seen in FIG. 4, the twisted connecting segment 38-2 of the second prong-socket member is joined directly to the bifurcated socket element S-2 at a location along the letter near the open end of its gap 43-2 between socket fingers 41-2 and 42-2.

Figure 6:
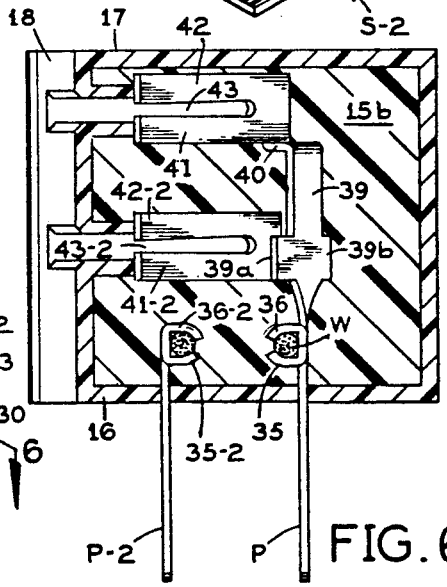
FIG. 6 is a cross-section taken along the line 6—6 of FIG. 5.

In the manufacture of a complete plug-and-socket unit as shown in FIG. 5, the two prong-socket members are positioned as shown in FIGS. 6–10, with the bifurcated socket elements S and S-2 spaced apart laterally (FIG. 6) and co-planar (FIGS. 7 and 8) at an angle of about 30 degrees to what will be the bottom 21 of the molded plastic insulation body 15 in which the prong-socket members will be encapsulated. The open front edges of socket elements S and S-2 are aligned laterally, as shown in FIG. 6. The transverse connecting segment portion 40 of the first prong-socket member projects up from the common plane of socket elements S and S-2 and the flat connecting segment portion 39 of the first prong-socket member is spaced above and parallel to the socket element S-2 of the second prong-socket member. The wire attachment segment 34,35,36,37 of the first prong-socket member is spaced behind the wire attachment segment, 34-2, 35-2, 36-2, 37-2 of the second prong-socket member, as best seen in FIG. 6, and the prong element P of the first prong-socket member extends parallel to and behind the prong element P-2 of the second prong-socket member. Lead-in wires W and W-2 are connected respectively to the first and second prong-socket members by crimping the fingers 35,36,37 and 35-2, 36-2, 37-2 of these members to the bared ends of the lead-in wires.

The ground prong 24 is positioned above and between the prong element P and P 2, with the inner end of prong 24 connected to a socket element of known design (not shown) which is located above and between the bifurcated socket element S and S-2.

With these parts positioned as described, the plastic core 15*b* of the dielectric body 15 of the plug-socket unit is molded around these parts except the projecting portions of prong elements P, P-2 and 24. Then the outer layer 15*a* of this dielectric body is molded around its core 15*b* to complete the formation of the plug-socket unit.

FIG. 10 shows how the bifurcated socket elements S end S-2 of the prong-socket members in this plug-socket unit receive the prong elements 50 and 51 of a plug 52 on the end of an insulated electrical cable 53. The fingers 41 and 42 of socket element S on the first prong-socket member grip the prong element 50 of plug 52 between them, and the fingers 41-2 and 42-2 of socket element S-2 on the second prong-socket member grip the prong element 51 of plug 52 between them.

A second embodiment of the invention is illustrated in FIGS. 11–17. As compared to the embodiment of FIG. 1–10, the same reference numerals are used for like parts in the embodiment of FIGS. 11–17.

Figure 11:
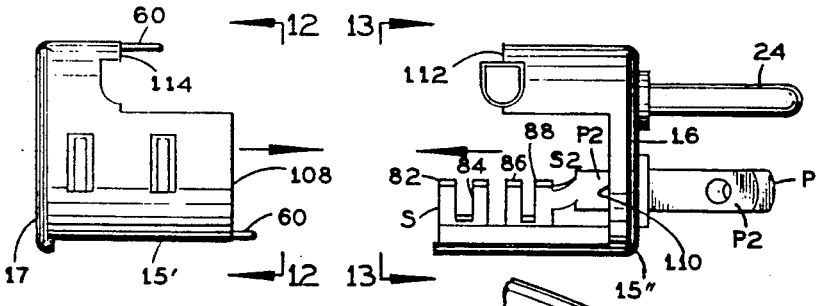
FIG. 11 is an elevational view of the two sections of an insulating body in accordance with another embodiment of the invention.
Figure 12:
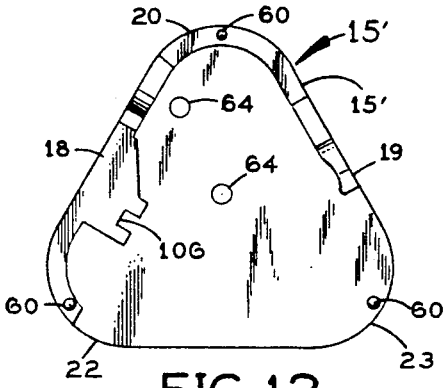
FIG. 12 is an elevational view along line 12—12 of FIG. 11.
Figure 13:
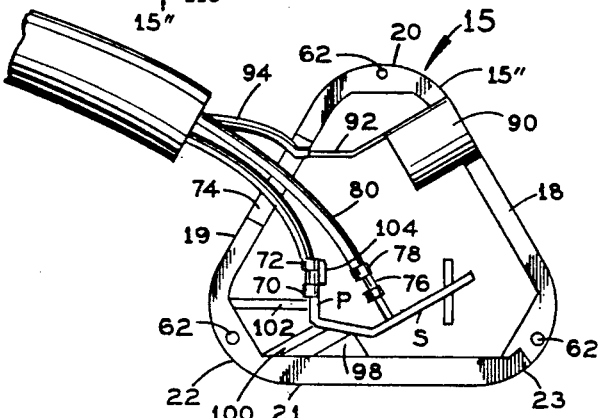
FIG. 13 is an elevational view taken along line 13—13 of FIG. 11.
Figure 14:
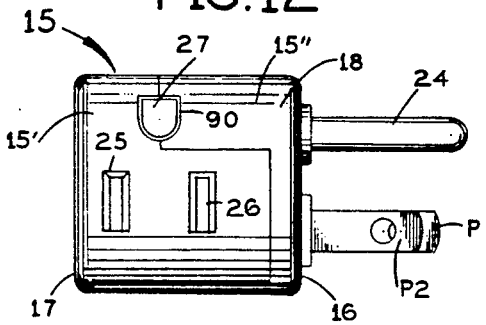
FIG. 14 is a front elevational view of an assembled "piggyback" plug socket unit embodying these two sections.

The dielectric plastic body 15 is separable into two parts 15' and 15" (FIGS. 11, 12 and 13). The complete plastic body unit 15 is shown in FIGS. 14–17. The body 15 has flat opposite end faces 16 and 17, a flat front face 18 extending between these end faces, a flat rear face 19 extending down behind the front face 18 at en angle of about 60° end connected to it by a rounded top corner 20, and a flat bottom face 21 extending between the front and back faces 18 and 19 at respective angles of about 60° and connected to them by rounded rear and front corners 22 and 23.

The two body halves 15' and 15" may be snapped together to form the plastic body 15. Body half 15' has pins 60 that fit into opening 62 at the corners of body half 15". Other pins 64 help keep the parts in place and the wires separated.

Figure 15:
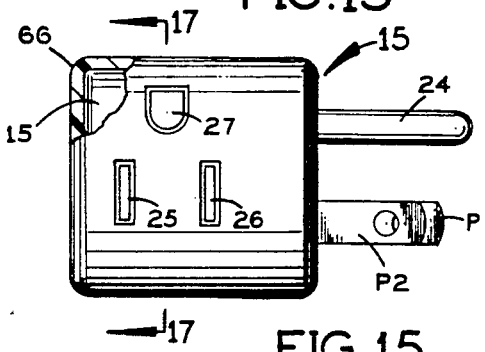
FIG. 15 is a front elevational view similar to FIG. 14 but with an overmolding layer on the assembly.
Figure 17:
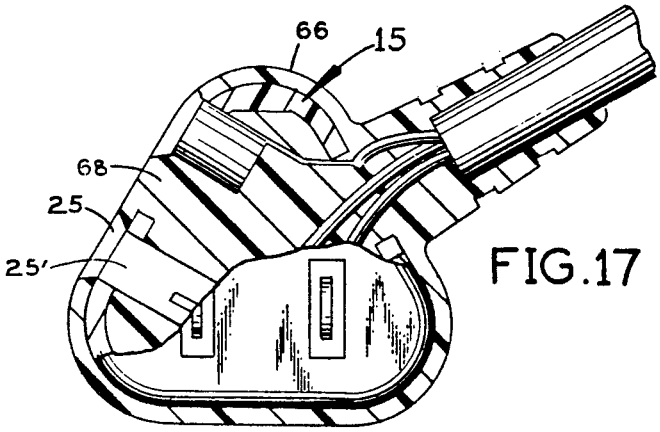
FIG. 17 is a sectional view taken along line 17—17 of FIG. 15.
Figure 16:
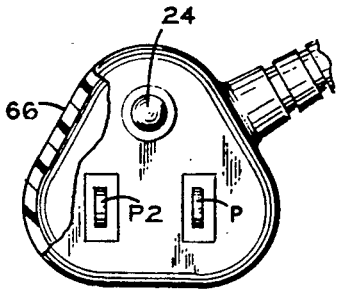
FIG. 16 is an elevational view of the right end of the unit of FIG. 15.

In the completed plug-socket unit, shown in FIGS. 15, 16 and 17, the body 15 has an overmolding of plastic material that has an outer layer 66 over the body 15. The material of the overmolding also at least partially fills the interior of body 15 as at 68.

Flat electrical prong elements P and P2 project perpendicularly away from end face 16 of the body 15, as does the ground prong 24 of round cross-section.

The front face 18 of insulation body 15 has a pair of rectangular openings 25 and 26 leading into internal recesses, one of which, 25', is shown in FIG. 17 for receiving flat prongs on another electrical connector like the prong elements P and P2. The front face 18 has a third opening 27 rounded on one side for receiving a ground prong on the other electrical connector.

The first prong-socket member has a prong element P like that described in the first embodiment. At the inner end of prong element P (FIG. 11) there is a bifurcated socket element S and a connecting segment 70 (FIG. 13). The connecting segment 70 has fingers 72 for receiving a lead-in wire 74 which is soldered to the connecting segment 70. At the inner end of prong element P2 there is another bifurcated socket element S2 (FIG. 11) and a connecting segment 76 (FIG. 13). The connecting segment 76 has fingers 78 for receiving a lead-in wire 80 which is soldered to the connecting segment 76.

The socket elements S and S2 are coplanar and side-by-side as shown in FIGS. 11 and 13. Socket element S has fingers 82 and 84 on opposite sides of a gap. Socket element S2 has fingers 86 and 88 on opposite sides of a gap. The gaps are both open at the end away from the connecting segments. Socket element S2 is hidden in FIG. 13 and only connecting segment 76 is visible. In opening 27 there is a socket element 90 which is hollow and has a finger 92 to which a lead-in ground wire 94 is soldered.

The inner end of prong P where it makes contact with socket element S is not visible in FIG. 11, but that inner end is seen in FIG. 13.

When another electrical connector with prongs like the prongs P, P2 and 24 is inserted into the openings 25, 26 and 27, the prongs will make contact with the socket elements S, S2 and 90. The fingers 82 and 84 of socket element S receive the prong-like prong P between them, the fingers 86 and 88 of socket element S2 receive the prong-like prong P2 between them, and the hollow socket element 90 receives the rounded prong-like prong 24 in the hollow interior and contacting its walls.

The socket elements S and S2 are bent somewhat as shown in FIG. 13. The inner ends thereof rest on ridges 98 and 100 of body 15 as seen in FIG. 13. The inner end of prong P rests on a ridge 102 and is located behind an ar 104 that projects from face 16 of the insulating body 15. This arm is hidden by the socket elements S and S2 in FIG. 11 but is visible in FIG. 13. The face 18 of housing section 15' has a guideway 106 that receives the outer ends of the fingers of the socket elements S1 and S2 when the section 15' and 15" are assembled. The projecting portion 108 of section 15' fits into recess 110 in section 15", and projection 112 of section 15" fits into recess 114 of section 15' upon assembly of sections 15' and 15".

The prongs P, P2 and 24 extend parallel to each other on the inside and outside of the insulating body. The socket elements S and S2 of the prong-socket members that have flat prongs P end P2 are parallel to each other inside the body 15, and the hollow socket member 90 is also parallel to socket elements S and S2.

The prong 24 of the grounded prong-socket member has an internal portion that connects to finger 92 leading from socket element 90.

From the foregoing description and the accompanying drawing it will be apparent that the present invention facilitates the manufacturing operation because of the integral construction of the two prong-socket members and their unique configurations enabling the proper positioning of the prong and socket elements in the finished plug-socket unit.

I claim:

1. An electrical plug-socket unit comprising:

a dielectric body having a plurality of exposed faces disposed at angles to one another;

and first and second integral, substantially rigid prong-socket members of electrically conductive material embedded in said dielectric body, each of said prong-socket members having opposite ends, with a prong element at one of said ends and a socket element at the opposite ends;

said prong elements of said prong-socket members protruding through one of said faces of said dielectric body and extending parallel to each other at the outside of said one face;

said socket elements of said prong-socket members extending parallel to each other within said dielectric body behind another of said faces;

said dielectric body having openings in said other face leading into said socket elements, wherein each of a pair of said prong-socket members is an elongated one-piece body having:

an elongated, thin, substantially planar prong element at said one end thereof;

an elongated , bifurcated, thin substantially planar socket element at said opposite end thereof;

and a connecting segment between said prong and socket elements positioning the plane of said socket elements at an angle to the plane of said prong element; wherein said socket element of each of said prong-socket members has an opening which is offset beyond the plane of the prong element of said prong-socket member toward said other face of said dielectric body, and wherein said socket element of each of said prong-socket members has elongated, substantially flat fingers on opposite sides of a gap having one end thereof said opening in said socket element.

2. An electrical plug-socket unit according to claim 1 wherein said gap between said fingers in the socket element of each of said prong-socket members is narrowest in the vicinity of said one end where said opening in the socket element is located.

3. An electrical plug-socket unit according to claim 2 wherein said connecting segment of each of said prong-socket members is twisted.

4. An electrical plug-socket unit according to claim 3 wherein said connecting segment of said first prong-socket member is substantially longer than said connecting segment of said second prong-socket member, and said connecting segment of said first prong-socket member has a bend therein which offsets said socket element of said first prong-socket member laterally from said socket element of said second prong-socket member.

5. An electrical plug-socket unit comprising:

a dielectric body having a plurality of exposed faces disposed at angles to one another;

and first and second integral, substantially rigid prong-socket members of electrically conductive material embedded in said dielectric body, each of said prong-socket members having opposite ends, with a prong element at one of said ends and a socket element at the opposite ends;

said prong elements of said prong-socket members protruding through one of said faces of said dielectric body and extending parallel to each other at the outside of said one face;

said socket elements of said prong-socket members extending parallel to each other within said dielectric body behind another of said faces;

said dielectric body having openings in said other face leading into said socket elements, wherein each of a pair of said prong-socket members is an elongated one-piece body having:

an elongated, thin, substantially planar prong element at said one end thereof;

an elongated, bifurcated, thin substantially planar socket element at said opposite end thereof;

and a connecting segment between said prong and socket elements positioning the plane of said socket elements at an angle to the plane of said prong element; wherein said connecting segment of said first prong-segment member is substantially longer than said connecting segment of said second prong-socket member, and said connecting segment of said first prong-socket member has a bend therein which offsets said socket element of said first prong-socket member laterally from said socket element of said second prong-socket member.

6. An electrical plug-socket unit according to claim 5 wherein said socket element of each of said prong-socket members has an opening which is offset beyond the plane of the prong element of the same prong-socket member in the direction of said other face of said dielectric body.

7. An electrical plug-socket unit comprising:

a dielectric body having a plurality of exposed faces disposed at angles to one another;

and first and second integral, substantially rigid prong-socket members of electrically conductive material embedded in said dielectric body, each of said prong-socket members having opposite ends, with a prong element at one of said ends and a socket element at the opposite ends;

said prong elements of said prong-socket members protruding through one of said faces of said dielectric body and extending parallel to each other at the outside of said one face;

said socket elements of said prong-socket members extending parallel to each other within said dielectric body behind another of said faces;

said dielectric body having openings in said other face leading into said socket elements, wherein each of a pair of said prong-socket members is an elongated one-piece body having:

an elongated, thin, substantially planar prong element at said one end thereof;

an elongated, bifurcated, thin substantially planar socket element at said opposite end thereof;

and a connecting segment between said prong and socket elements positioning the plane of said socket elements at an angle to the plane of said prong element; wherein said socket element of each of said prong-socket members has elongated, substantially flat fingers on opposite sides of a gap extending from an opening in said socket element; and wherein said opening in the socket element of each of said prong-socket members is located beyond the plane of the prong element of the same prong-socket member toward said other face of said dielectric body.

8. An electrical plug-socket unit according to claim 7 wherein said other prong-socket member has said hollow socket element in alignment with a prong opening in said body, and has said gap in alignment with other prong openings in said body.

* * * * *